US005896690A

United States Patent [19]

Suesholtz

[11] Patent Number: 5,896,690

[45] Date of Patent: Apr. 27, 1999

[54] BASE MOULDING FOR FRAMING SHADOWBOXES AND THE LIKE

[75] Inventor: Herbert Suesholtz, Harrison, N.Y.

[73] Assignee: T I Industries Inc., Lexington, N.C.

[21] Appl. No.: 09/071,553

[22] Filed: May 1, 1998

[51] Int. Cl.[6] ..... A47G 1/06

[52] U.S. Cl. ..... 40/743; 40/800; 52/656.1

[58] Field of Search ..... 40/732, 743, 768, 40/769, 800; 52/656.1, 656.2, 656.4, 592.6

[56] References Cited

U.S. PATENT DOCUMENTS

D. 276,781 12/1984 McIntire, Jr. ..... D6/306
D. 370,568 6/1996 Wynne ..... D6/306
4,920,718 5/1990 Artwick et al. ..... 52/656 X
4,939,858 7/1990 Dailey ..... 40/152.1
5,581,953 12/1996 Ruff ..... 52/656.2 X
5,806,223 9/1998 Visagie ..... 40/800

*Primary Examiner*—Brian K. Green
*Assistant Examiner*—Daniel Gambrill
*Attorney, Agent, or Firm*—Hedman, Gibson & Costigan, P.C.

[57] ABSTRACT

Base mouldings useful to form shadow boxes from a multitude of commonly-available decorative frame parts comprise three-dimensional lengths of wood or the like provided with an eight-sided, right-angled cross-section comprising a top side, a bottom side, a left side, a right side, an upper two-sided rabbet between the top side and the right side and a lower two-sided rabbet between the bottom side and the right side.

7 Claims, 2 Drawing Sheets

BASE MOULDING FOR FRAMING SHADOWBOXES AND THE LIKE

FIELD OF THE INVENTION

This invention relates to base mouldings for framing shadowboxes for displaying 3-dimensional objects, such as gems, fossils, medals, and the like, and in particular to novel mouldings suitable for the easy assembly of shadow boxes.

BACKGROUND OF THE INVENTION

Frames for decorative art, mirrors, posters and like are conventionally formed from a plurality (usually four) of sides, or frame parts, which are cut from longer pieces of mouldings, of up to about 16 feet in length, and thereafter joined to each other at mitered ends. Small, custom framers literally have thousands of such decorated frame parts, either in their own inventory, or readily available from a number of suppliers. However, when their customers have 3-dimensional objects to be displayed, even though the customer likes a particular decorated frame, they are often disappointed to find that specialized framing is necessary to accommodate the thickness of the article to be displayed. Not only are there increases in the expense and labor required to assemble the construction, but in the present state of the art, none of the many beautifully decorated frames carried by, or available to, small, custom framers can be used. In addition, obviously, in making individual shadowboxes much effort is needed to carefully measure and miter the individual frame members and to secure proper fitting. It would be desirable, therefore to provide shadow box base mouldings based on a novel eight-sided cross section which can be mitered and assembled with a minimum of effort into a shadowboxes decorated with the broadest selection of ordinary picture frames and such mouldings in lengths of up to about 16 feet are provided in accordance with the instant invention.

SUMMARY OF THE INVENTION

According to the present invention there are provided articles of manufacture adapted to form the base of a shadow box decorated with commonly available picture frame mouldings, the article having a length, a height and a thickness and having an eight-sided, right-angled cross-section comprising a top side, a bottom side, a left side, a right side, an upper two-sided rabbet between the top side and the right side and a lower two-sided rabbet between the bottom side and the right side.

Preferred embodiments of this aspect of the invention comprise base mouldings as defined above wherein the length is from about 8 inches to about 192 inches, the height is from about 1 inch to about 4 inches and the thickness is from about 7/16 inch to about 1 inch; those wherein the upper rabbet is recessed from about 1/16 inch to about ½ inch from the top side and from about ⅜ inch to about 13/16 inch from the right side and the lower rabbet is recessed from about ⅛ inch to about ½ inch from the bottom side and from about ⅛ inch to about ½ inch from the right side; especially those wherein the upper rabbet is recessed from about 1/16 inch to about ½ inch from the top side and from about ⅜ inch to about 13/16 inch from the right side and the lower rabbet is recessed from about ⅛ inch to about ½ inch from the bottom side and from about ⅛ inch to about ½ inch from the right side. Special mention is made of the most preferred embodiments wherein, in the article, the upper rabbet is recessed about ¼ inch from the top side and about 9/16 inch from the right side and the lower rabbet is recessed about ¼ inch from the bottom side and from about ¼ inch from the right side and the height of the left side is from 1⅜ inches to 3½ inches.

Also contemplated by the present invention are frame assemblies adapted to form a shadowbox for displaying 3-dimensional objects and the like comprising four frame parts comprising segments of an article of manufacture as first above defined each segment having a pair of oppositely mitered ends abutting flatly with and adjoined to the corresponding ends of the neighboring frame parts such that two continuous ledges are formed around said frame assembly by said upper and lower rabbets. Also contemplated by the invention are frames for a shadowbox comprising at least two frame assemblies as defined above combined in tandem by inserting a first frame assembly having a suitably sized bottom side into the upper rabbet in the corresponding second frame assembly, and, if desired, repeating the procedure with one or more additional frame assemblies so as to provide additional depth.

Among its preferred features, the present invention contemplates frame assemblies which include in the ledge formed by its upper rabbet a four-sided frame having an outwardly facing decorative surface, and, in particular, those wherein the four-sided frame having an outwardly facing decorative surface encloses a transparent planar viewing window. Also provided by the present invention are shadow boxes comprising a frame assembly as defined above wherein the lower-most ledge formed by the lower two-sided rabbet is provided with opaque planar means for displaying 3-dimensional objects and the like. Special mention is made of embodiments wherein at least the outside of each frame part in the shadowbox base moulding is decorated with a black coating.

DESCRIPTION OF THE PREFERRED EMBODIMENTS

Figure 1:
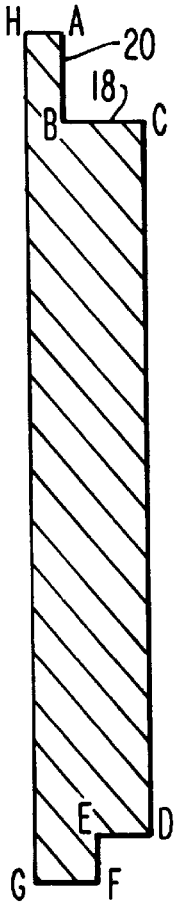
FIG. 1 is a cross-sectional view of an eight-sided three-dimensional shadow box base moulding in accordance with the present invention.

FIG. 1 shows the critical shape of the base moulding of the present invention. All of the above-mentioned advantages flow from selection of this configuration. For purposes of illustration and to simplify understanding, reference to FIG. 1 will be used hereinafter and in the appended claims to differentiate the top side, the bottom side, the left side and the right side. Furthermore, the length will refer to a distance measured to the ends of a line (not shown) being perpendicular to the plane of FIG. 1, the height will refer to the overall distance between the top and the bottom of FIG. 1, and the thickness will refer to the overall distance between the left and the right of FIG. 1. Unless otherwise specifically indicated, all angles are right angles and mitered angles will comprise two segments each comprised of 45 degree angles.

Figure 2:
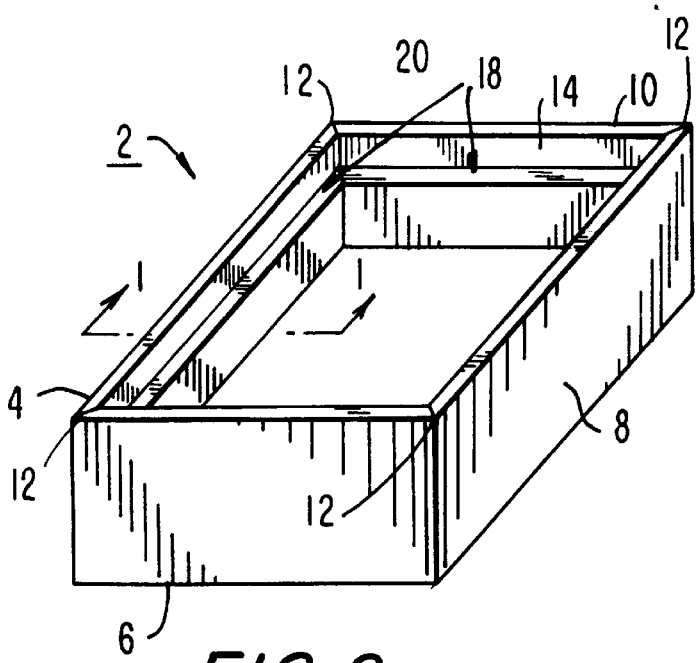
FIG. 2 is a perspective view looking down on a mitered frame comprised of four segments of the base moulding accordance with the present invention, open at the top, FIG. 1 being a cross section taken along line 1—1.
Figure 4:
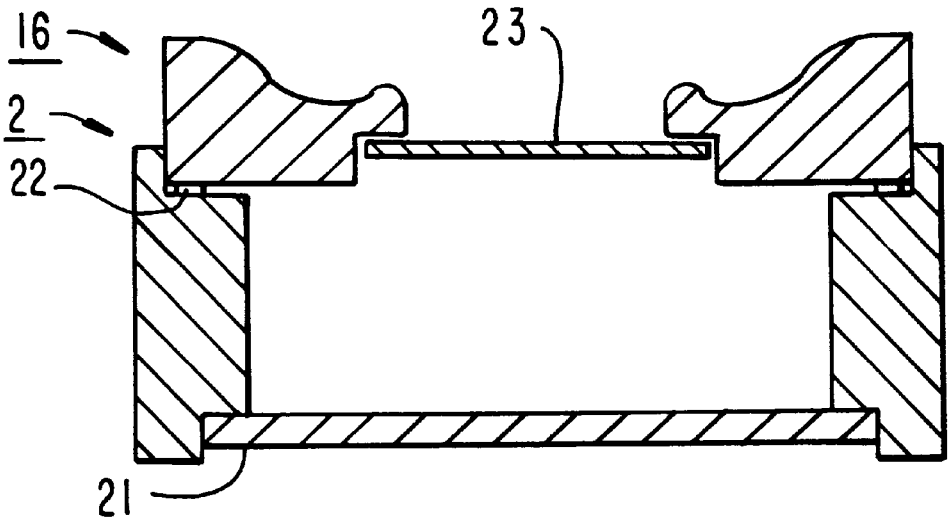
FIG. 4 is a cross section view of the frame assembly produced by enclosing the frame of FIG. 2 with the decorated frame of FIG. 3 and illustrates an optional glass in the frame and a mounting board located in the lower ledge of the frame.

FIGS. 2 and 4 show a preferred embodiment of the present invention, comprising rectangular shaped bottom frame assembly 2 comprising four straight frame parts 4, 6, 8 and 10. Each frame part 4, 6, 8 and 10 is formed from the shadow box base moulding of the invention and has a pair of oppositely mitered 45° ends 12 abutting flatly with and adjoined to the corresponding ends 12 of the neighboring frame parts.

Figure 3:
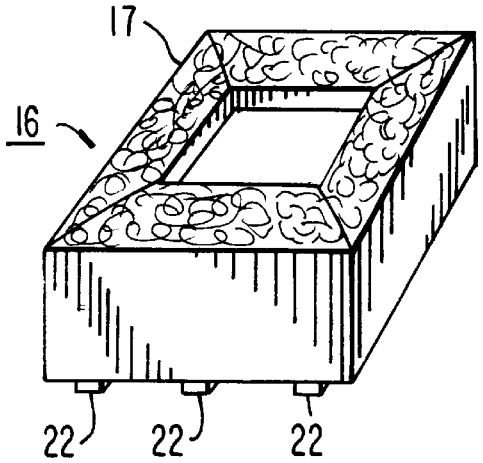
FIG. 3 is a top perspective view of a preferred means for decorating the shadow box comprising a four-sided frame made from decorative picture frame moulding adapted to fit in the upper ledge formed by the frame assembly of FIG. 2, to enclose the display space and to permit viewing the contents.

Each frame part 4, 6, 8 and 10 is integrally formed with an eight-sided cross-section. FIG. 1 shows this cross section in frame parts 4, 6, 8 and 10. A continuous rabbet 14 is formed around the bottom frame assembly 2 and the ledge produced thereby faces upwardly for receiving the front face of a suitably sized four sided frame 16 made from decorated commonly available and well known picture frame mouldings such frames being constructed preferably with mitered corners as shown in FIG. 3. This upper rabbet comprises a top facing portion 18 and an inside facing portion 20. As is shown in FIGS. 1 and 4, a continuous rabbet can also be formed in the downwardly facing opening of frame 2 and optionally in decorative frame 16, and the ledges formed thereby are respectively adapted to receive entirely optional planar closure means 21 which can, for example, comprise a mounting board, and entirely optional transparent viewing means 23 which can, for example, comprise glass.

Figure 5:
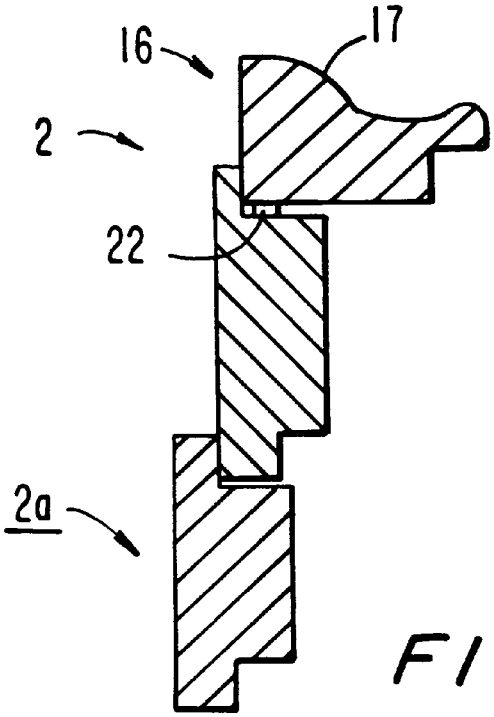
FIG. 5 is a partial cross section view of another frame assembly of the present invention produced by joining two shadowbox base moulding frames of the type shown in FIG. 2 and decorating the tandem assembly with a picture frame moulding as shown in FIG. 3.

To accommodate any desired depth, the shadowbox base moulding of the present invention can be used in tandem as illustrated by FIG. 5. Two or more boxes 2 and 2*a* can be joined by coupling and the uppermost ledge can be decorated by inserting a suitably sized four-sided frame 16 made from a commonly available picture frame moulding such as 17.

To provide stability between the top frame and the bottom frame, as well as between tandem frames, a plurality of lateral movement preventing means are strategically located on the front face 18 of the rabbet 14 of the frame assembly 2. Although such means can comprise nails, glue, other fasteners, and the like, in the preferred embodiment, the lateral movement preventing means are strips 22 of resilient compressible foam tape having pressure sensitive adhesive disposed on opposite sides thereof for adherence to the frame assembly 2. Usually, lengths between 3 inches to 6 inches are satisfactory, but the length can be varied for different frame dimensions. The larger the frame, the longer the strips that will be needed. By way of example, 3 inch strips will suffice for frames up to 20 inches by 24 inches, and 6 inch strips will cover frames up to 30 inches by 40 inches. Similar fastening means can be used to provide stability for the optional planar means 21 used to enclose the lower part of the assembly.

Instead of a mounting board, a suitably shaped planar sheet 21 of rigid or semi-rigid material, for example a transparent material such as glass or plexiglass, or a mirror or board such as masonite, is sized to fit snugly within the lower-most rabbet. Fastening the planar sheets 16 and 21 is desirable because it reduces the stress on the mitered joints 12.

Practice has taught that, for any given construction certain sizes and other parameters should be preferred. This has a very practical effect, because by restricting the dimensions, the framer need measure the outside width and length of the top frame and make the bottom (base) frame to these exact dimensions, using the bottom rabbet as the guide. This simplifies the construction because a framer knows just how to do this.

Using the system of the present invention, to avoid such problems, for example for stock thicknesses of from 7/16 inch to 1 inch, with respect to the moulding shown in cross-section in FIG. 1, (1) angles ABC, BCD, DEF, FGH, should be all right angles. (2) A line drawn through point G parallel to line A-B should not be further from point A than 1/8 inch to 1/2 inch. (3) Line B-C should not be less than 3/8 inch nor more than 13/16 inch in length. (4) Line E-D should not be less than 1/8 inch nor more than 1/2 inch in length. (5) Line E-F should not be less than 1/8 inch nor more than 1/2 inch in length. (6) Line H-A can be a line parallel to G-F or any contour in which point H is never higher than point A. (7) Line C-D should be more than 1/2 inch and less than 3 inches in length for best results.

Practice has shown that this invention eliminates completely the tedious measurements and reworking problems of mouldings used to make prior art frames. Many different frames can be produced at a lower cost because waste is eliminated, because the profiles can be shaped from smaller blocks of materials. Following the teachings herein using the novel mouldings provided by the invention also reduces the separation of the mitered joints because they fit much better. The present invention is useful with mouldings made from wood, plastic, metal, or wood derivatives.

Many variations of the present invention will suggest themselves to those skilled in this art in light of the above detailed description and the accompanying drawings. All such obvious variations are within the full intended scope of the appended claims.

I claim:

1. A frame for a shadowbox comprising two frame assemblies, each of the two frame assemblies comprising four frame parts having a length, a height and a thickness and having an eight-sided, right-angled cross-section comprising a top side, a bottom side, a left side, a right side, an upper two-sided rabbet between said top side and said right side and a lower two-sided rabbet between said bottom side and said right side each of the frame parts having a pair of oppositely mitered ends abutting flatly with and adjoined to corresponding ends of neighboring frame parts such that two continuous ledges are formed by said upper and lower rabbets, each of the frame assemblies being combined in tandem by inserting one of the frame assembly having a suitably sized bottom side into the one of the ledges of the other corresponding frame assembly.

2. A frame assembly as defined in claim 1 further comprising one or more additional frame assemblies so as to provide additional depth.

3. A frame assembly as defined in claim 2 which includes within the ledge formed by an uppermost rabbet a four-sided frame having an outwardly facing decorative surface.

4. A frame assembly as defined in claim 3 wherein said four-sided frame having an outwardly facing decorative surface encloses a transparent planar viewing window.

5. A shadowbox comprising a frame assembly as defined in claim 4 wherein the ledge formed by an lowermost rabbet is provided with an opaque planar means for displaying 3-dimensional objects.

6. A frame assembly adapted to form a shadowbox for displaying 3-dimensional objects, said frame assembly comprising four frame parts having a length, a height and a thickness and having an eight-sided, right-angled cross-section comprising a top side, a bottom side, a left side, a right side, an upper two-sided rabbet between said top side and said right side and a lower two-sided rabbet between said bottom side and said right side, each of the frame parts having a pair of oppositely mitered ends abutting flatly with and adjoined to corresponding ends of neighboring frame parts such that two continuous ledges are formed by said upper and lower rabbets, and which also includes within the ledge formed by said upper rabbets a four-sided frame having an outwardly facing decorative surface.

7. A shadowbox comprising a frame assembly, the frame assembly comprising four frame parts having a length, a height and a thickness and having an eight-sided, right-angled cross-section comprising a top side, a bottom side, a left side, a right side, an upper two-sided rabbet between said top side and said right side and a lower two-sided rabbet between said bottom side and said right side, each of the frame parts having a pair of oppositely mitered ends abutting flatly with and adjoined to corresponding ends of neighboring frame parts such that two continuous ledges are formed by said upper and lower rabbets, which also includes in the ledge formed by said upper rabbets a four-sided frame having an outwardly facing decorative surface, said four-sided frame also enclosing a transparent planar viewing window, and wherein the ledge formed by said lower rabbets is provided with an opaque planar means for displaying 3-dimensional objects.

* * * * *